US005749494A

United States Patent [19]

Wolski et al.

[11] Patent Number: 5,749,494

[45] Date of Patent: May 12, 1998

[54] JUICE DISPENSER

[75] Inventors: Peter Wolski, Algonquin; Michael S. Long, Wauconda, both of Ill.

[73] Assignee: IMI Wilshire Inc., Anoka, Minn.

[21] Appl. No.: 695,726

[22] Filed: Aug. 12, 1996

[51] Int. Cl.[6] ..... B67D 5/56

[52] U.S. Cl. ..... 222/129.1; 222/148; 137/240

[58] Field of Search ..... 222/129.1, 148, 222/333, 325; 137/240, 239

[56] References Cited

U.S. PATENT DOCUMENTS

| | | | |
|---|---|---|---|
| Re. 33,943 | 6/1992 | Arzberger et al. | 62/127 |
| 3,995,770 | 12/1976 | Schwitters | 222/129.1 |
| 4,189,067 | 2/1980 | Nottke et al. | 222/57 |
| 4,194,650 | 3/1980 | Nottke et al. | 222/57 |
| 4,645,095 | 2/1987 | Coppola | 222/64 |
| 4,703,770 | 11/1987 | Arzberger et al. | 137/88 |
| 4,717,045 | 1/1988 | Coppola | 222/64 |
| 4,856,676 | 8/1989 | Emody | 222/64 |
| 5,000,348 | 3/1991 | Emody | 222/66 |
| 5,348,192 | 9/1994 | Sardynski et al. | 137/240 |

OTHER PUBLICATIONS

Wilshire Corporation Installation and Service Manual, SLJ Series Juice Dispenser Feb. 4, 1994.

*Primary Examiner*—Philippe Derakshani
*Attorney, Agent, or Firm*—Vickers, Daniels & Young

[57] ABSTRACT

A beverage dispenser for dispensing one or more fruit or vegetable beverages. The dispenser includes a housing design to hold one or more liquid containers filled with a fruit or vegetable concentrate and a fluid metering mechanism for providing the liquid concentrate from the liquid containers to a consumer. The fluid metering mechanism is a modular component which simplifies maintenance and repair of the dispenser and further reduces leakage.

81 Claims, 6 Drawing Sheets

JUICE DISPENSER

The present invention relates generally to a beverage dispenser, and more particularly to a post-mix type dispenser for dispensing fruit juice, vegetable juice and the like, although the invention has broader applications and may be used for dispensing other types of food products and liquid materials.

BACKGROUND OF THE INVENTION

Numerous prior art references exist pertaining to mixing systems for the dispensing of one or more liquids. The prior art also includes systems for mixing a liquid concentrate with a liquid diluent to dispense a final juice product. Such juices may include fruit and vegetable juices or the like. Typically, the juice concentrate is placed in a container and maintained at a desired temperature by a cooling system incorporated in the dispenser. Such dispensers are illustrated in U.S. Pat. Nos. 4,703,770; 4,717,045 and RE 33,943. Dispensers which dispense fruit and vegetable juices must be periodically cleaned to ensure that the dispensed liquid is safe for consumption. Dispensers equipped having removable containers are more difficult to clean and require the operator to remove the container, fill the container with a flush solution and replace the container back into position to begin the flushing process. These steps have to be repeated until the dispenser components are satisfactorily cleaned. To overcome such inconveniences, dispensers have been developed which incorporate a flush valve that directs a flushing solution through the dispenser without having to remove the container. The flush valve is generally located near the area the container is connected to the dispenser plumbing. The flush valve is designed to direct a flushing fluid into the plumbing components of the dispenser such as the pump unit and dispensing nozzle, the two most difficult components to clean. One such dispenser is disclosed in U.S. Pat. No. 5,000,348.

Although the use of a flush valve has simplified the cleaning of the dispenser, the use of a flush valve has caused several problems. One problem associated with the use of flush valves is the leaking of the flush valve during operation. Due to the complexity of the flush valve design, liquids passing through the flush valve periodically seep from the flush valve and spill onto other dispenser components. Such spillage can result in the frequent cleaning of the dispenser and may further result in damage to dispenser components such as electronic components. Another problem associated with using flush valves is the cost associated with manufacturing and repairing such flush valves. Due to the complex design of the flush valves, many of the components must be machined made. These machined components require low error tolerances. Such low error tolerances result in manufacturing of many unsatisfactory components which results in significant waste and higher costs. Machined parts are also labor intensive resulting in a high cost per unit. The complex valving arrangement of the flush valve also results in the need for a complex sealing configuration to properly seal the flush valve during operation. This complex sealing configuration is very costly to incorporate and are susceptible to rapid wear and leakage.

Yet another problem associated with prior dispensers is the cost and difficulty of repairing such dispensers. Moving parts such as the pump and flush valve periodically need repairing. Such repair usually requires the dispenser to be taken to a repair area and a substitute dispenser to be used, if available, until repairs are completed. Such repairs are costly, time consuming and difficult to implement due to the complex arrangement of components in the dispenser and due to the time and costs necessary to transport the dispenser to and from the repair area. Due to the cost and problems associated with dispensers, there is a substantial need for a dispersement arrangement which is easy to repair, simpler to manufacture and which reduces or eliminates leakage of fluid.

SUMMARY OF THE INVENTION

The present invention relates to a beverage dispenser, and more particularly to a post-mix beverage dispenser for dispensing fruit and vegetable juices which is significantly easier to operate, maintain and repair and includes substantial improvements in valve and component design and reduced manufacturing and repair costs.

In accordance with the preferred embodiment of the present invention, there is provided a beverage dispenser which includes a housing for supporting the internal and external components of the beverage dispenser. The housing is designed to hold one or more liquid containers filled with a liquid such as a fruit or vegetable juice concentrate. The housing may also include a refrigeration unit to maintain the liquid within the container at a proper temperature. Connected to the face of the housing is preferably one or more dispensement nozzles from which a final liquid product is dispensed to the consumer. Inside the housing is included a fluid metering mechanism which controls the amount of liquid dispensed from the liquid container to the dispensement nozzle. The fluid metering mechanism preferably includes a container coupling mechanism which connects the liquid container to a pump mechanism for pumping the liquid from the liquid container to the dispensement nozzle. The pump mechanism may include a pump motor and a pump. The fluid metering mechanism may also include a valve block designed to mix the liquid in the liquid container with a diluent prior to dispensing the final liquid product. The liquid in the liquid container is preferably a concentrate and must be diluted prior to consumption. A brix controller may be incorporated to control the amount of dilution of the liquid concentrate. The container coupling mechanism is designed to include several components such as a flush valve, a container adapter and a connector bottom. The container adapter is designed to integrate with the liquid container and form a connection with the liquid container which minimizes leakage. The connector bottom is designed to be coupled with the pumping mechanism and to minimize leakage of liquid as it passes to the pump mechanism. The flush valve is designed to be a moveable component which is substantially sealed between the container adapter and the connector bottom. A sealing mechanism which preferably incorporates seals such as O-rings is used to substantially seal the flush valve between the container adapter and the connector bottom. The container coupling mechanism also includes a seating arrangement which is used to assist in sealing and orienting the container adapter, connector bottom and flush valve. The dispenser may also incorporate an electrical circuit and/or control circuit to control the operation and/or flushing of the dispenser.

In accordance with another aspect of the present invention, the seating arrangement includes a seating section and a seat cavity which is designed to telescopically receive the seat section. Preferably, the seat section is a member which extends upwardly or downwardly from one or more of the components of the container coupling mechanism. The seating section preferably has a substantially uniform circular cross-sectional area which provides for one or more components of the container coupling mechanism to rotate. The seat cavity is designed to preferably have a substantially uniform circular cross-sectional and further to have a cross-sectional diameter which is slightly greater than the cross-sectional diameter of the seating section. As can be appreciated, the positioning of the seating section and the seat cavity on the connector adaptor, flush valve and/or connector bottom can be arranged in many ways. One such preferable combination includes a seating section positioned on the top of the connector bottom which is inserted into a seat cavity in the base of the flush valve. The flush valve further includes a seating section at the top of the flush valve which is inserted into a seat cavity in the base of the connector adaptor.

In accordance with yet another aspect of the present invention, the container coupling mechanism is provided with a sealing system which substantially reduces and/or prevents liquid from leaking from the components of the container coupling mechanism. Various sealing arrangements can be employed to seal the components of the coupling mechanism together to achieve a substantially leak-free coupling mechanism. One preferable sealing arrangement includes positioning a seal about the peripheral edge of each seating section. For seating sections having a circular cross-sectional area, a seal such as a rubber or plastic O-ring is preferably used. The seal is preferably maintained in position on the seating section by providing a seal slot in the peripheral edge of the seating section. The depth of the seal slot is designed to preferably receive only a portion of the seal so that the part of the seal extends beyond the peripheral edge of the seating section. The extension of the seal from the peripheral edge of the seating section is designed to engage the interior wall of a seat cavity when the seating section is telescopically inserted into the seat cavity. The engagement of the seal with the interior wall of the seat cavity provides a liquid seal between the seating section of one component and the seat cavity of another component. The positioning the seal on the peripheral edge of the seating section also allows one or more components of the container coupling mechanism to rotate with respect to another component. Furthermore, the positioning of the seal on the peripheral edge of the seating section facilitates in ease of removal of the seal when the seal needs to be replaced. However, it will be appreciated that the seal may be alternatively inserted in the interior wall of the seating cavity. In this arrangement, a seal slot is preferably provided in the interior wall of the seat cavity to receive the seal and to maintain the seal in its desired position when the seating section is telescopically inserted in the seat cavity. To provide for additional sealing between the seat section and the seat cavity, two or more seals may be provided on the peripheral edge of the seating section or interior wall of the seating cavity or one or more seals may be provided on the peripheral edge of the seating section and the interior wall of the seat cavity.

In accordance with still yet another aspect of the present invention, the container coupling mechanism is designed to both provide a passageway for the liquid from the container to the pump mechanism and to further provide an arrangement for directing a flushing fluid through the pump mechanism to periodically sanitize and clean the dispenser components. The flush valve is preferably designed to be moved between at least two positions. In one position, the flush valve allows liquid from the liquid container to pass through the coupling mechanism and into the pump mechanism. In the second position, the flush valve is designed to block the flow of liquid from the liquid container to the pump mechanism and to further direct a flushing fluid into the pump mechanism. The container coupling mechanism preferably includes a position detector to detect when the flush valve is in the first position and/or second position. The position detector may be electrically connected to a control circuit in the dispenser which controls the flushing mode of the dispenser. The position detector may be designed to signal the operator of the dispenser about the position of the flush valve.

In accordance with another aspect of the present invention, the connector adaptor of the container coupling mechanism is designed to quickly couple and quickly release the liquid container. Preferably, the container adaptor includes an arcuate shaped lip which easily receive and direct the nozzle of a container. The container nozzle and/or container adaptor may include a seal to prevent liquid in the container from leaking out of the top of the container adaptor.

In accordance with yet another aspect of the present invention, the container adaptor includes an actuator pin for opening a valve in the nozzle of the liquid container when the liquid container is received into the container adaptor. Preferably, the nozzle of the liquid container includes a spring biased valve such as a ball valve which is biased in the closed position. Upon inserting the liquid container into the container adaptor, the actuator pin of the container adaptor contacts and depresses the spring biased valve into an open position thereby allowing liquid from the liquid container to flow through the valve and into the container adaptor. Upon removal of the liquid container from the container adaptor, the spring valve of the nozzle moves into the closed position. Such a design minimizes the leakage from the liquid container when the liquid container is inserted into and removed from the container adaptor.

In accordance with still yet another aspect of the present invention, the container coupling mechanism includes a liquid sensor for detecting the existence of liquid in one or more components of the container coupling mechanism. Preferably, the liquid sensor is positioned in the container adaptor so as to immediately sense when the liquid container is empty of liquid. The liquid sensor may be designed in any number of ways to detect the presence of liquid. One such arrangement preferably includes the use of one or more electrodes positioned in the container adaptor, which electrodes are connected to a monitor to monitor current between the electrodes. Most liquids include electrolytes which can conduct a current. When such a liquid interacts with the two electrodes, a current can be conducted between the electrodes. However, when the liquid does not conduct the two electrodes, no current can pass between the electrodes. Therefore, the presence of liquid about the electrodes can easily be detected. For liquids not containing electrolytes, other sensing mechanisms, can be used. The liquid sensor may be connected to a control system for indicating to a user when the liquid container is empty.

In accordance with yet another aspect of the present invention, one or more components of the container coupling mechanism are molded or extruded components. Preferably, a majority of the plastic components which make up the container coupling mechanism are extruded or molded components. Such components are easier to manufacture and are significantly less expensive to manufacture than machined parts. Furthermore, molded and extruded components have a much higher consistency with respect to part design and tolerances. The molded or extruded components can be made of less material than machined parts thus making the parts lighter and less costly to manufacture.

The improved consistencies of these designs and tolerances further improves the leak-proof design of the components, reduces the wear of the components and provide for better operation of the components.

In accordance with another aspect of the present invention, one or more components of the fluid metering mechanism are modular components. By designing modular components in the fluid metering mechanism, replacement and/or servicing of the components is greatly facilitated. Preferably, the complete fluid metering mechanism which includes the container coupling mechanism and the pump mechanism is designed as a single modular component. In such arrangement, the fluid metering mechanism can be easily removed and replaced when the pump mechanism, container coupling mechanism and/or plumbing between the pump mechanism and the container coupling mechanism are broken, damaged or otherwise malfunctioning. The modular arrangement allows a new modular component to be replaced on site without having to completely remove the dispensing device and substituting a new dispensing device while the malfunctioning dispensing device is taken to a service area. The modular design also facilitates an easier servicing of the components by allowing the operator to conveniently remove the components in one package instead of piecemeal removal of the components in the dispenser.

The primary object of the present invention is to provide a dispenser which includes a dispensement arrangement which reduces leakage problems, which is easy to service and which is more cost effective to manufacture.

Another object of the present invention is the provision of a container coupling mechanism which includes a seating arrangement which assists in the orientation and sealing of the components of the container coupling mechanism.

Still yet another object of the present invention is the provision of a seating arrangement which includes one or more seals to form a seal between a seating section and a seat cavity.

Another object of the present invention is the provision of a container coupling mechanism which includes at least two positions whereby one position allows liquid to be dispensed from a liquid container through the container coupling mechanism and a second position which provides for flushing of the dispenser components.

Still yet another object of the present invention is the provision of a container coupling mechanism which includes a position detector for detecting when the container coupling mechanism is in the liquid dispensing mode or the dispenser flush mode.

Yet another object of the present invention is the provision of a container coupling mechanism which includes a quick release arrangement to easily receive and remove a liquid container.

Still another object of the present invention is the provision of a container coupling mechanism which includes an actuator mechanism for opening a valve in the liquid container when the liquid container is inserted onto the container coupling mechanism.

Another object of the present invention is the provision of a container coupling mechanism which includes a liquid detection device for detecting the presence of liquid.

Yet another object of the present invention is the provision of one or more components of the container coupling mechanism which are made of molded or extruded plastic parts. Yet still another object of the present invention is the provision of one or more components of the dispenser which attached to a modular component so as to be easily removed and replaced in the dispenser.

These and other objects and advantages will become apparent to those skilled in the art upon reading and following the description taken together with the accompanying drawings.

BRIEF DESCRIPTION OF THE DRAWINGS

Reference may now be made to the drawings, which illustrate various embodiments that the invention may taken in physical form and in certain parts and arrangement of parts wherein.

DETAILED DESCRIPTION OF THE PREFERRED EMBODIMENT

Figure 1:
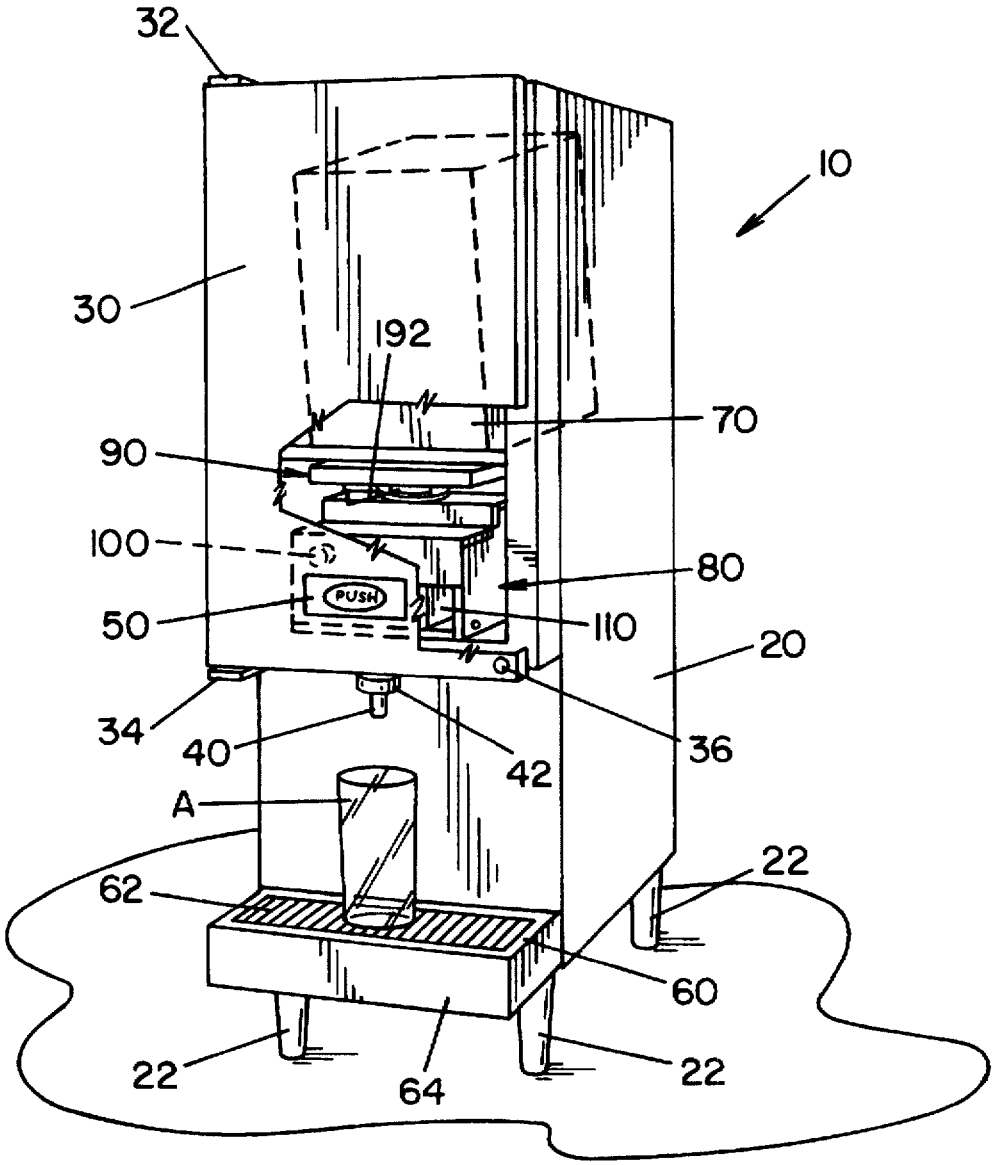
FIG. 1 is a pictorial view of the front of a dispenser of the present invention.

Referring now to the drawings, wherein the showings are for the purpose of illustrating the preferred embodiments of the invention only and not for the purpose of limiting the same, in FIG. 1 there is shown a dispenser 10 designed to dispense a liquid beverage to a consumer. Dispenser 10 includes a dispenser housing 20 which is supported by four dispenser legs 22. Dispenser 10 also includes a housing door 30 which provides access to the interior of the housing. Housing door 30 is shown to be hingeably mounted on door hinges 32 and 34 which enable the housing door to be opened and closed. The housing door is also provided with a door lock 36 to secure the housing door in a closed position.

The front face of the housing includes a cup platform 60. The cup platform is designed to support a cup A for receiving a dispensed liquid. Cup platform 60 includes a platform grill 62 which provides a cover to spill reservoir 64. Platform grill 62 is designed to allow liquid which is not captured in cup A to pass through the platform grill and into spill reservoir 64. Positioned above cup platform 60 is nozzle 40 which is secured to the housing by a nozzle bushing 42. Nozzle 40 directs a dispensed liquid downwardly into cup A when a consumer depresses dispenser button 50. The depression of the dispenser button activates a fluid metering controller 80 which directs a liquid stored in liquid container 70 through nozzle 40. The liquid in liquid container 70 is preferably a fruit or vegetable concentrate. As can be appreciated, dispenser 10 can be designed to house one or more liquid containers, one or more fluid metering controllers, one or more dispenser buttons, and one or more nozzles to dispense one or more liquids from the dispenser. Although not shown, the housing door may be designed to include a lighted display panel for purposes of listing the types of products dispensed and/or to display other types of information or advertising.

Figure 2:
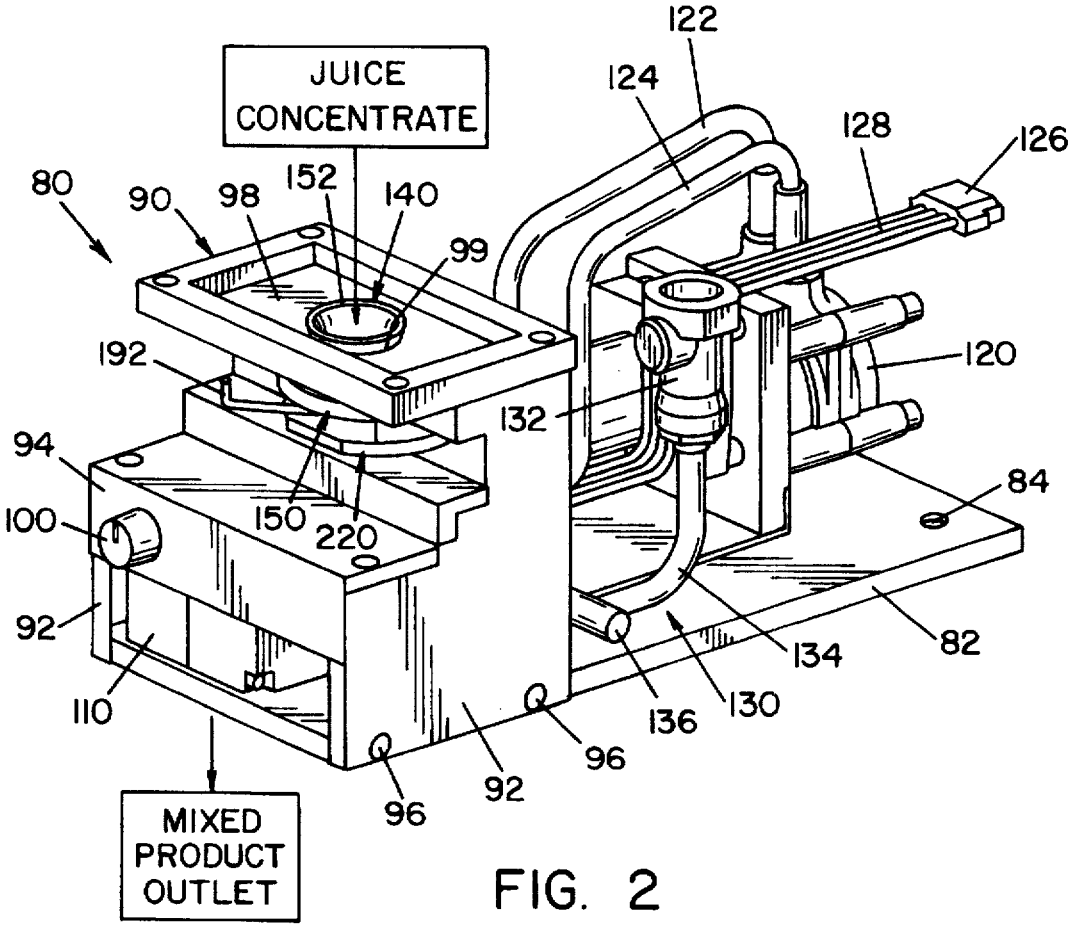
FIG. 2 is a pictorial view of one of the fluid metering mechanism of the present invention and is illustrated as modular component.

Referring now to FIG. 2, fluid metering controller 80 is designed in a modular form and is the primary component for controlling the flow of liquid from liquid container 70 to nozzle 40. Fluid metering controller 80 includes a support platform 82 which is used to mount the various components of the fluid metering controller. The support platform includes one or more platform mount holes 84 to mount the fluid metering controller in the interior of housing 20. Fluid metering controller 80 also includes a container adaptor support 90 which is supported in position by housing side panels 92. Container adaptor support 90 includes a trough region 98 which is designed to capture liquid which leaks from liquid container 70. Container adaptor support 90 also includes a coupling hole 99 designed to be affixed about one of the components of container coupling assembly 140. Also connected to housing side panel 90 is a splash panel 94. Splash panel 94, like container adaptor support 90, is designed to prevent liquid, which leaks from liquid container 70, from contaminating or damaging other components of the fluid metering controller or other components of dispenser 10. The container adaptor support 90, housing side panels 92, and splash panel 94 are connected together by one or more housing screws 96.

Extending from the front face of splash panel 94 is a brix dial 100. The brix dial allows an operator to adjust the dilution of the liquid in liquid container 70 prior to being dispensed through nozzle 40. The brix dial is connected to a valve block assembly 110. The valve block assembly 110 is designed to facilitate in the mixing of the liquid from liquid container 70 with a diluent liquid such as water. The valve block assembly 110 is provided with a diluent liquid from diluent manifold assembly 130. Diluent manifold assembly 130 includes a diluent source connector 132 designed to be adapted with the diluent source. Preferably, the diluent source is a water line which can be easily coupled to the diluent source connector. Connected to diluent source connector 132 is a primary diluent tube 134 which in turn is connected to diluent distributor tube 136. Diluent distributor tube 136 provides a diluent liquid to valve block assembly 110 and to container coupling assembly 140. The configuration of the valve block assembly 110 and diluent manifold 130 are well known in the art and will not be further described.

Fluid metering controller 80 also includes a pump motor assembly 120. The pump is preferably a peristaltic pump and is driven by an electric motor. Two pump tubes 122, 124 are attached to the pump motor assembly 120 and provide a liquid passageway between container coupling assembly 140 and valve block assembly 110. The configuration of the pump and motor are well known in the art and will not be further described.

Fluid metering controller 80 also includes an electronic connector 126 which is connected to electric cable 128. Electronic connector 126 connects the electronics of modular fluid metering controller 80 to a control system and/or indicator, not shown. Such electronic components of the fluid metering controller 80 may monitor or control the brix level, monitor the liquid in the fluid metering controller 80, monitor and control of the flow of liquid through pump-motor assembly 120 and/or monitor and control of the flushing mode of the dispenser. Preferably, the electronic cable also provides power to the pump-motor assembly 120.

As can be appreciated, the modular design of fluid metering controller 80 facilitates in the ease of replacement and of repair of the fluid metering controller and dispenser. By providing all the fluid metering controller components, which are most susceptible to maintenance and to repair, on a single modular unit, the repairs to the dispenser will often be completed on site by merely replacing a modular unit with another modular unit without having to completely remove the dispenser to a service location. Furthermore, the modular design of the fluid metering controller allows for the modular component to be easily removed from the dispenser and easily serviced in its modular form rather than having to individually remove various components from the dispenser unit.

Referring now to FIGS. 3–7, the container coupling assembly 140 of fluid metering controller 80 will now be described. Container coupling assembly 140 is designed to be coupled with liquid container 70 to provide a passageway from liquid container 70 to the other components of the container coupling assembly. The container coupling assembly is also designed to allow the dispenser to be changed between dispensement mode of operation and a flushing mode of operation. The flushing mode of operation provides for the cleaning of liquid concentrate from the various components in dispenser 10 for purposes of periodically cleaning the internal components of the dispenser.

Container coupling assembly 140 includes a container adaptor 150 which is designed to couple with liquid container 70. The container adaptor includes an adaptor lip 152. Adaptor lip 152 is arcuate shaped and provides for a wide opening near the edge of the lip to facilitate with the coupling of the liquid container 70 to container adaptor 150. The walls of connector adaptor 150 define an adaptor shaft 151, which shaft is open at the top face of container adaptor 150. Adaptor shaft 151 is designed to have a substantially uniform circular cross-sectional area between the shaft base 153 and adaptor lip 152. The adaptor shaft is designed to telescopically receive a container valve, not shown, when liquid container 70 is inserted into container adaptor 150. Shaft base 153 provides a support ledge for the container adaptor to rest upon when liquid container 70 is inserted into container adaptor 150. Container adaptor 150 is also provided with an actuator pin 154 mounted into two pin slots 156 which are located in shaft base 153. Actuator pin 154 is designed to depress a spring biased valve ball, not shown, located in the container valve of liquid container 70. The ball valve is preferably spring biased in the closed position thereby preventing liquid in liquid container 70 from spilling out of the liquid container as the liquid container 70 is positioned into container adaptor 150. Actuator pin 154 maintains the valve ball in the open position thereby allowing liquid in the liquid container 70 to freely flow from the liquid container into adaptor shaft 151. When liquid container 70 is to be replaced, the liquid container is lifted from container adaptor 150 resulting in actuator pin 154 releasing pressure on the valve ball thereby allowing the valve ball to move into the closed position. The adaptor shaft 151 and/or the container valve include a seal to reduce any leakage between the liquid container and the container adaptor. This design of the container adaptor provides for quick coupling and quick release of the liquid container from the container adaptor.

Two liquid sensors 170 are provided in container adaptor 150. Each liquid sensor 170 is housed in a sensor housing 172 and is inserted into a sensor hole 174. The two sensor holes are positioned substantially diametrically apart from one another and are positioned in the side of the connector adaptor such that the holes are generally level with or slightly above shaft base 153. The liquid sensors are designed to be of sufficient length to intersect the interior of adaptor shaft 151 to detect the presence of liquid in adaptor shaft 151. The liquid sensors are connected to an indicator or electronic control panel, not shown.

Adaptor shaft 151 terminates into adaptor channel 158 generally at shaft base 153. Adaptor channel 158 narrows in cross-sectional diameter near the shaft base and subsequently maintains a substantially constant cross-sectional diameter until opening into adaptor seat cavity 167. Positioned in the top of adaptor seat cavity 167 and adjacent to the adaptor channel is an adaptor channel seal slot 160. Positioned at least partially in seal slot 160 is an adaptor channel seal 162 which is preferably a plastic or rubber O-ring.

Container adaptor 150 also includes an adaptor mount housing 164 which includes one or more mount slots 166. The adaptor mount housing is designed to secure connector adaptor 150 to various components of the fluid metering controller. Container adaptor 150 also includes a valve sensor support 176 which is designed to support a valve sensor 178. Valve sensor 178 is mounted to valve sensor support 176 by one or more sensor screw 180. Valve sensor 178 is designed to detect when container coupling assembly 140 is in the liquid dispersement mode or the flushing mode. Valve sensor 178 includes one or more sensor connectors 182 which are connected to an electronic controller and/or indicator, not shown. Positioned on the opposite face from sensor connector 182 is sensor actuator 184 designed to sense to the mode of operation of container coupling assembly 140.

The base of container adaptor 150 includes one or more bottom mount holes 186 designed to receive one or more mount screws 248 for mounting together the connector adaptor with the other components of container coupling assembly 140. Container coupling assembly 140 also includes a flush valve 190 which is designed to change the mode of operation of the container coupling system 140 between the flush mode of operation and the dispersement mode of operation. Flush valve 190 includes a valve handle 192 connected to valve base 205 which allows an operator to move the flush valve between the dispersement mode and the flush mode as illustrated in FIGS. 3–6.

Flush valve 190 includes a liquid passageway 194 which has a cross-sectional diameter that is substantially equal to the cross-sectional diameter of adaptor channel 158. The liquid passageway 194 extends from the seat top surface 198 of valve seat 196 to valve seat cavity 212 and has a substantially uniform cross-sectional diameter throughout the longitudinal length of the passageway.

Figure 3:
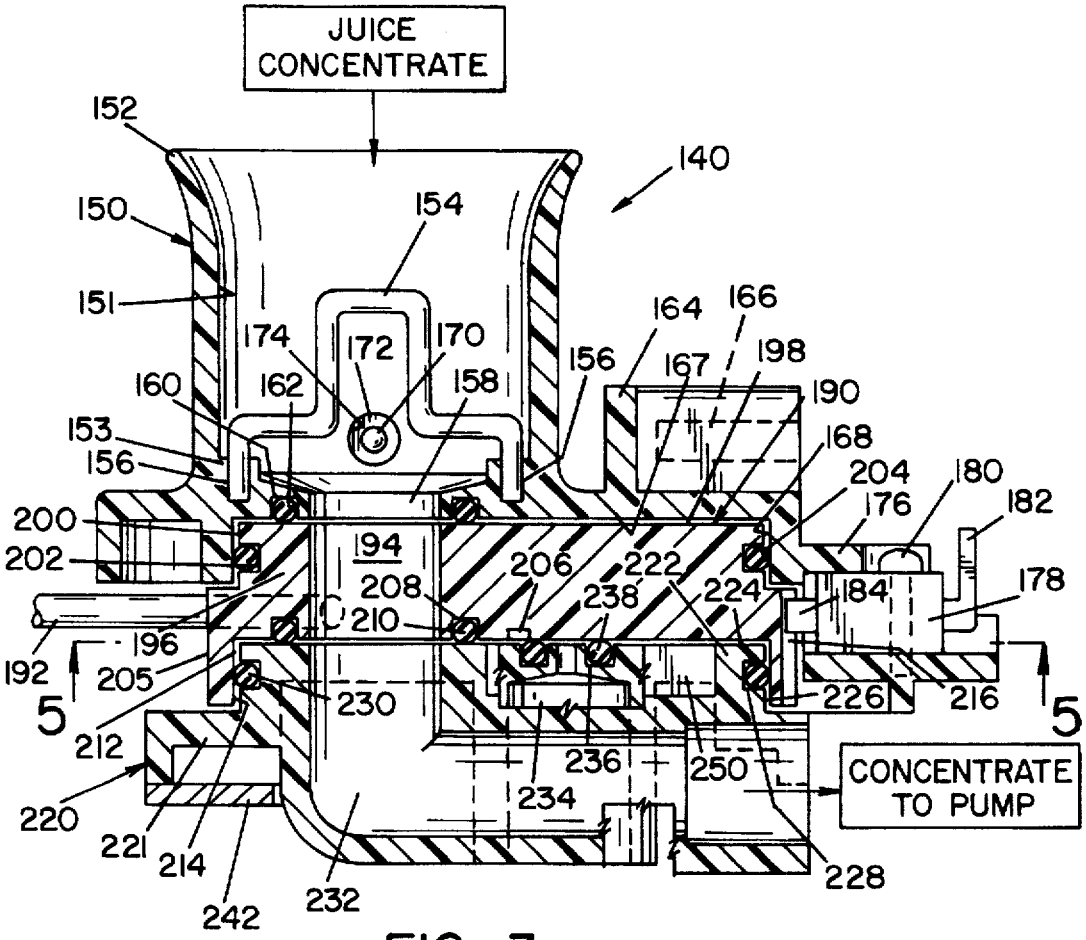
FIG. 3 is a cross-sectional elevation view of the container coupling mechanism of the present invention which is positioned in the liquid dispersement mode.
Figure 4:
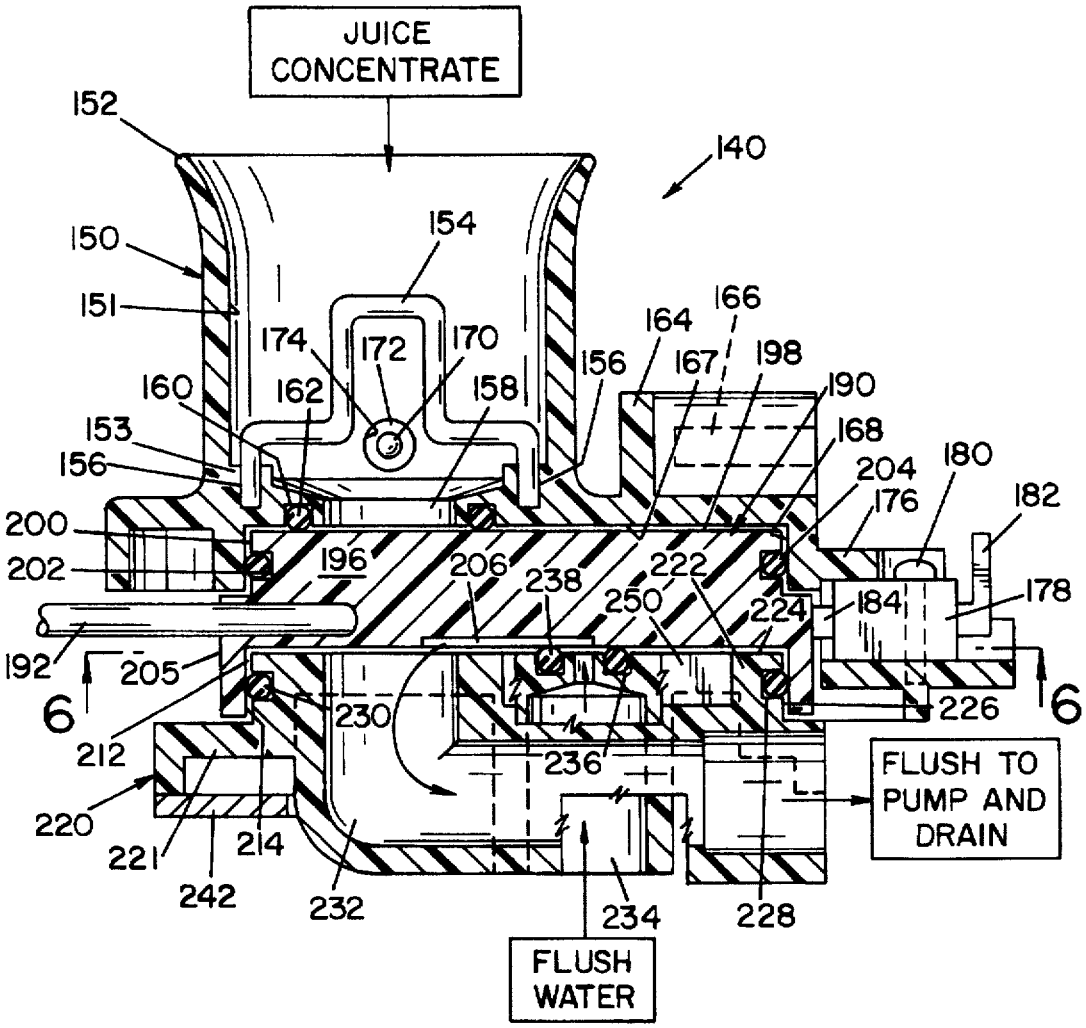
FIG. 4 is a cross-sectional elevation view of the container coupling mechanism of the present invention which is positioned in the flush mode.

The valve seat 196 connected to the top of valve base 205 has a seat top surface 198 and a seat side surface 200. The valve seat has a substantially uniform cross-sectional diameter. The cross-sectional diameter of valve seat 196 is selected to be slightly less than the cross-sectional diameter of the adaptor seat cavity 167 to allow the seat side surface 200 to be telescopically inserted into adaptor seat cavity 167 and lie closely adjacent to cavity side wall 168 of adaptor seat cavity 167. Seat side surface 200 includes a seat slot 202 which extends about the peripheral edge of seat side surface 200. Inserted partially in seat slot 202 is a seat seal 204 which is preferably a plastic or rubber O-ring. As best illustrated in FIGS. 3 and 4, seat seal 204 and adaptor channel seal 162 create a dual seal arrangement between flush valve 190 and container adaptor 150 to prevent liquid from leaking out of container coupling assembly 140 as liquid passes from adaptor channel 158 to liquid passageway 194. The sealing arrangement in combination with the design of valve seat 196 and adaptor seat cavity 167 allows flush valve 190 to be rotated with respect to container adaptor 150 while maintaining a substantially leak-free seal between the two components.

As best illustrated in FIGS. 3–6, flush valve 190 includes a valve seat cavity 212 positioned on the bottom of flush valve base 205. The valve seat cavity includes a cavity sidewall 214 which defines a cavity having a substantially uniform cross-sectional diameter throughout cavity 212. In the top of cavity 212, there is provided a flush channel 206 which provides a passageway for flush fluid to pass into liquid passageway 232 when flush valve 190 is positioned in the flush mode of operation, which operation will be later described. Positioned in the top of seat cavity 212 and adjacent to liquid passageway 194 is a passageway slot 208 which is designed to partially receive a passageway seal 210. The passageway seal is preferably a rubber or plastic O-ring. Flush valve 190 also includes a sensor slot 216 positioned in the peripheral edge of flush valve base 205. Sensor slot 216 is designed to interact with sensor actuator 184 of valve sensor 178. Sensor slot 216 is designed to telescopically receive sensor actuator 184 when the flush valve 190 is in the dispersement mode of operation as will be later described.

Container coupling assembly 140 also includes a connector bottom 220 which is designed to provide flush liquid to the container coupling assembly 140 and to further provide a passageway for the liquid from container 70 to the pump-motor assembly 120. Connector bottom 220 includes a bottom base 221 having a bottom seat 222 attached to the top thereof. Bottom seat 222 is designed to have a substantially uniform cross-sectional diameter. The cross-sectional diameter of bottom seat 222 is selected to be slightly less than the cross-sectional diameter of valve seat cavity 212 of flush valve 190 so that bottom seat 222 can be telescopically inserted into valve seat cavity 212. The peripheral edge of seat side surface 226 includes a seat side slot 228. Seat slot 228 is designed to partially receive a seat seal 230 which seal is preferably a plastic or rubber O-ring. As best illustrated in FIGS. 3 and 4, seat seal 230 is designed to interact with cavity side wall 214 when bottom seat 222 is inserted into valve seat cavity 212 thereby forming a seal between connector bottom 220 and flush valve 190. Furthermore, passageway seal 210 engages seat top surface 224 to provide an additional seal between connector bottom 220 and flush valve 190 when bottom seat 222 is inserted into the valve seat cavity.

Figure 5:
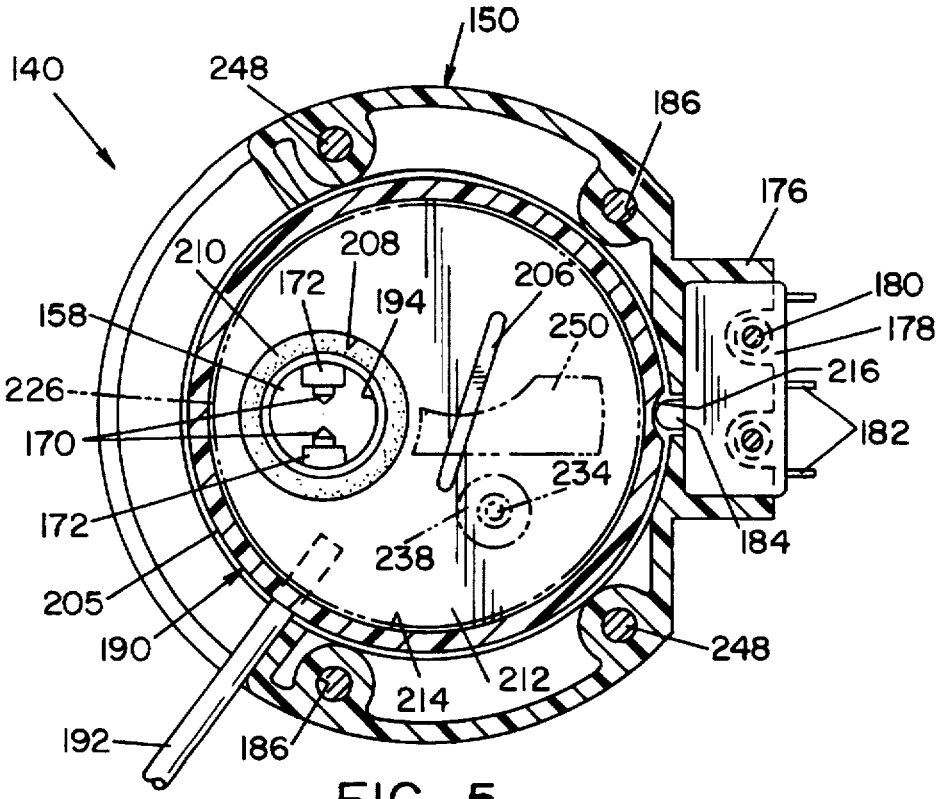
FIG. 5 is a cross-sectional view of FIG. 3 taken along lines 5—5.

Connector bottom 220 includes a bottom liquid passageway 232 which begins at the seat top surface and terminates in a sealed connection with one of the pump tubes leading to pump-motor assembly 120. The opening of bottom liquid passageway 232 in seat top surface 224 is positioned so as to be in direct alignment with adaptor channel 158 of connection adaptor 150. As illustrated in FIGS. 3 and 5, when flush valve 190 is positioned in the dispersement mode of operation, liquid passageway 194 of flush valve 190 connects the adaptor channel to the liquid passageway thereby allowing liquid in liquid container 70 to pass through container coupling assembly 140 and into pump-motor assembly 120. Seat seal 230 of connector bottom 220 and passageway seal 210 of flush valve 190 provides for a dual seal configuration between flush valve 190 and connector bottom 220 to prevent liquid from leaking out of container coupling assembly 140 when the liquid passes through liquid passageway 194 into bottom liquid passageway 232.

Figure 6:
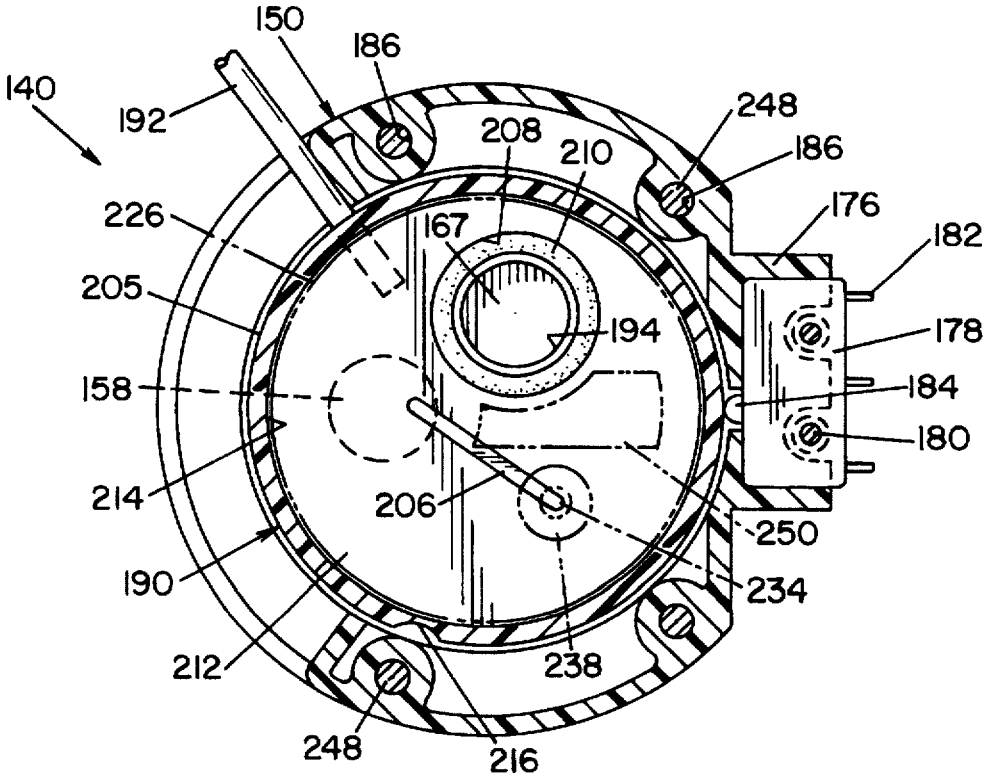
FIG. 6 is a cross-section view of FIG. 4 taken along lines 6—6.
Figure 7:
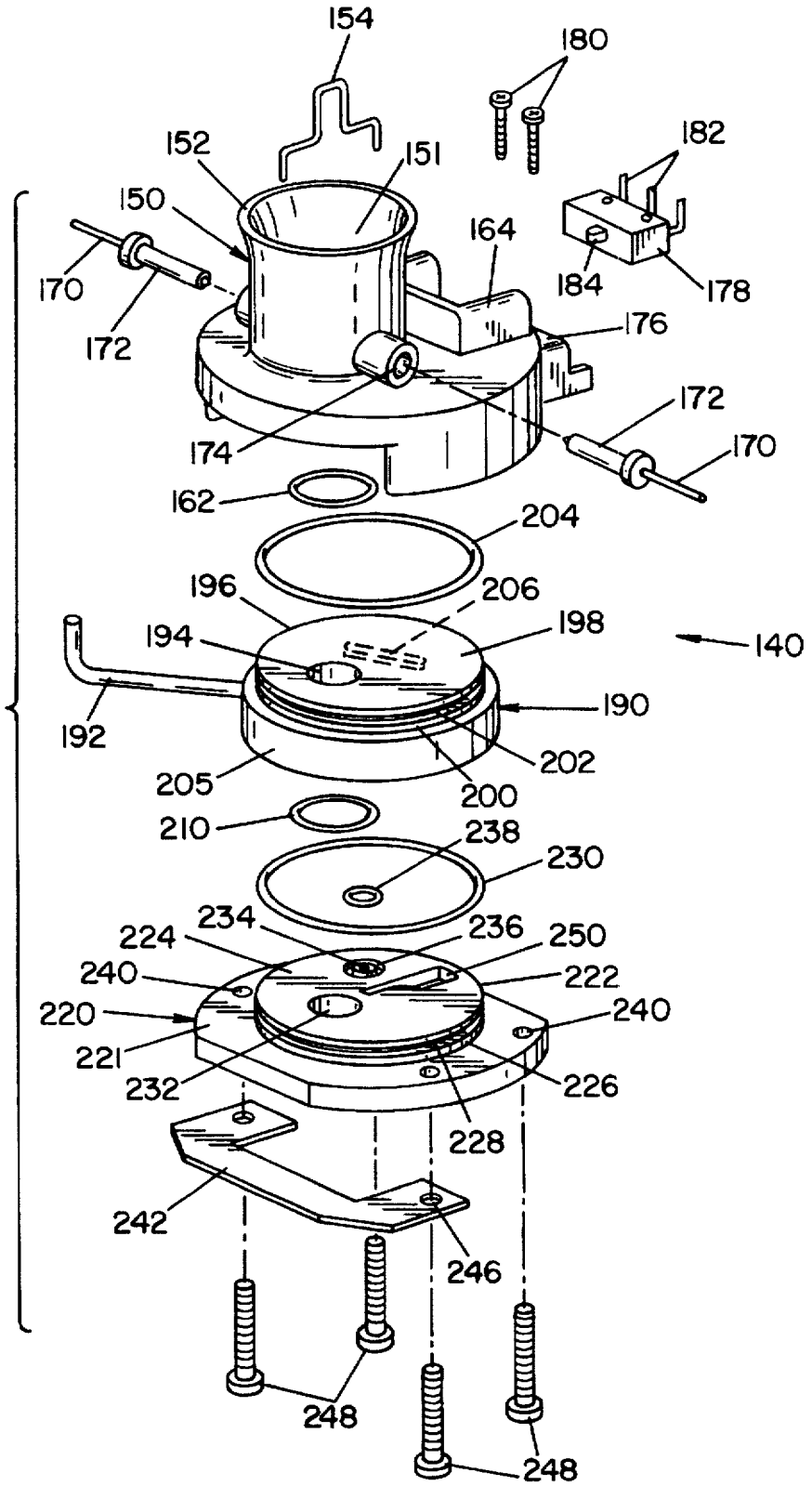
FIG. 7 is an exploded pictorial view of the container coupler mechanism illustrated in FIG. 3.

Referring now to FIG. 4, connector bottom 220 includes a flush liquid passageway 234 which terminates into seat top surface 224. Flush liquid passageway 234 becomes narrower as the passageway approaches the seat top surface. Positioned in the seat top surface and adjacent to flush liquid passageway 234 is a flush slot 236 which partially receives a flush seal 238 which seal is preferably made of a plastic or rubber O-ring. As illustrated in FIGS. 4 and 6, the flush fluid provided by flush liquid passageway 234 flows into the flush channel 206 and into bottom liquid passageway 232 when the flush valve is positioned in the flush mode of operation. Flush seal 238 in combination with seat seal 230 provide a dual seal arrangement to prevent flush fluid from leaking from the container coupling assembly.

Seat top surface 224 also includes a liquid reservoir 250 designed to store flushing fluid which is trapped within flush channel 206 when flush valve 190 is moved from the flushing mode to the dispersement mode.

Connector bottom 220 includes one or more bottom mount holes 240 which are designed to receive one or more mount screws 248. The mount screws secure connector bottom 220 to connector adaptor 150 thereby connecting together the components of the container coupling assembly. Connector bottom 220 also includes a bottom mount plate 242 which is connected to bottom base 221 by inserting mount screws 248 through plate hole 246 of bottom mount plate 242. The bottom mount plate is preferably made of metal and is designed to protect the connector bottom from being damaged when the connector coupling assembly is connected together and/or the connector coupling assembly is mounted in fluid metering controller 80.

The operation of the flushing mode and dispersement mode of the container coupling assembly 140 will now be described. The dispersement mode of operation of container coupling assembly 140 is best illustrated in FIGS. 3 and 5. During the dispensment mode of operation, the operator positions flush valve 190 into the dispensement mode by moving valve handle 192 to rotate the flush valve between the container adaptor and the connector bottom until valve sensor 178 indicates that the flush valve is in the dispensment mode of operation. Valve sensor 178 indicates that flush valve 190 is in the dispersement mode of operation when sensor actuator 184 is telescopically received into sensor slot 216 thereby causing valve sensor 178 to signal to the user and/or electronic controls of the dispenser that the flush valve is now in the dispersement mode of operation. Seals 162, 204, 210 228, and 230 ensure that the liquid flowing through the container coupling assembly does not deviate from adaptor channel 158, liquid passageway 194 and bottom liquid passageway 232. This seal arrangement is a significant improvement over the prior art in both its simplicity of design and efficiency of operation. The seal arrangement is designed to use circular seals instead of specially designed non-circular seals which are more costly to manufacture. Furthermore, the use of circular sealing rings, as compared to non-circular sealing rings, significantly reduces leakage between the components of the container coupling assembly during operating of the dispensement mode and of the flushing mode and during the movement of the flushing valve.

Referring now to FIGS. 4 and 6, the flushing mode of operation is illustrated. When the dispenser components need to be flushed of liquid concentrate, flushing valve 190 is moved into the flush mode position by moving valve handle 192. As shown in FIG. 6, as flush valve 190 is rotated, sensor actuator 184 moves out of sensor slot 216 causing sensor actuator 184 to be depressed into valve sensor 178. The movement of the sensor actuator causes the valve sensor to indicate that the flush valve has been moved into the flush mode of operation. In the flush mode of operation, the flush valve blocks adaptor channel 158 to prevent liquid concentrate from flowing into bottom liquid passageway 232. In addition, flush channel 206 aligns itself between flush liquid passageway 234 and bottom liquid passageway 232. This alignment of the flush channel allows the flush fluid to flow from flush liquid passageway 234 over flush seal 238 and into the bottom liquid passageway 232 thereby flushing out any liquid concentrate in connector bottom 220 and in various other plumbing components of the dispenser. The flush fluid, once it traverses flush seal 238 is allowed to flow between flush valve 190 and connector bottom 220 and clean the area between the flush valve and the connector bottom. Typically, the flush fluid is water which is provided from a tube leading from diluent distributor tube 136. As the flushing fluid travels into bottom liquid passageway 232, seat seal 230 prevent the flushing fluid from leaking from the connector coupling assembly and channel seal 162 and seat seal 204 prevent liquid concentrate from also leaking from the connector coupling assembly. Once the components of the dispenser have been sufficiently flushed, flush valve 190 is once again positioned into the dispersement mode of operation. As can be appreciated, the liquid container does not have to be removed during the flushing mode, thus simplifying the operation and cleaning of the dispenser.

The plastic components of the container adaptor, flushing valve and connector bottom are primarily molded or extruded components made of a rigid, and wear resistant material which resists wear and cracking.

The invention has been described with reference to a preferred embodiment and alternates thereof It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

We claim:

1. A beverage dispenser comprising a housing, at least one container means for enclosing a liquid, discharge means for dispensing said liquid, and fluid metering controller means for controlling the flow rate of said liquid from said container means to said discharge means, said fluid metering controller means including pump means for controllably moving said liquid to said discharge means and container coupling means for providing a passageway from said container means to said pump means, said container coupling means including a flush valve movably mounted and substantially sealed between a container adaptor and a connector bottom, said connector bottom including a bottom base, a seating section extending from said bottom base and bottom sealing means extending about the peripheral edge of said seating section for substantially sealing said flush valve to said connector bottom, said flush valve including base including base cavity means for telescopically receiving said seating section of said connector bottom.

2. A beverage dispenser as defined in claim 1, wherein said flush valve including a flush valve base and a seating section extending from said flush valve base and valve sealing means extending about the peripheral edge of said seating section for substantially sealing said flush valve to said container adaptor, and said container adaptor including adaptor cavity means for telescopically receiving said seating section of said flush valve.

3. A beverage dispenser as defined in claim 1, wherein said seating section of said connector bottom including a seating slot extending about said peripheral edge of said seating section, and said bottom sealing means at least partially positioned in said seating slot.

4. A beverage dispenser as defined in claim 2, wherein said seating section of said connector bottom including a seating slot extending about said peripheral edge of said seating section, and said bottom sealing means at least partially positioned in said seating slot.

5. A beverage dispenser as defined in claim 2, wherein said seating section of said flush valve including a seating slot extending about said peripheral edge of said seating section, and said valve sealing means at least partially positioned in said seating slot.

6. A beverage dispenser as defined in claim 4, wherein said seating section of said flush valve including a seating slot extending about said peripheral edge of said platform section, and said valve sealing means at least partially positioned in said seating slot.

7. A beverage dispenser as defined in claim 1, wherein said flush valve movable between a first position and a second position, said first position providing a passageway from said container means to said pump means, and said second position providing a passageway between a flushing fluid and said pump means.

8. A beverage dispenser as defined in claim 5, wherein said flush valve movable between a first position and a second position, said first position providing a passageway from said container means to said pump means, and said second position providing a passageway between a flushing fluid and said pump means.

9. A beverage dispenser as defined in claim 6, wherein said flush valve movable between a first position and a second position, said first position providing a passageway from said container means to said pump means, and said second position providing a passageway between a flushing fluid and said pump means.

10. A beverage dispenser as defined in claim 7, wherein said container coupling means including position detection means for detecting at least one position of said flush valve.

11. A beverage dispenser as defined in claim 8, wherein said container coupling means including position detection means for detecting at least one position of said flush valve.

12. A beverage dispenser as defined in claim 9, wherein said container coupling means including position detection means for detecting at least one position of said flush valve.

13. A beverage dispenser as defined in claim 1, wherein said container means including a container adaptor having valve means for sealing said liquid in said container, and said container adaptor including actuator means for opening said valve means when said container adaptor positioned in said container adaptor.

14. A beverage dispenser as defined in claim 11, wherein said container means including a container adaptor having valve means for sealing said liquid in said container, and said container adaptor including actuator means for opening said valve means when said container adaptor positioned in said container adaptor.

15. A beverage dispenser as defined in claim 12, wherein said container means including a container adaptor having valve means for sealing said liquid in said container, and said container adaptor including actuator means for opening said valve means when said container adaptor positioned in said container adaptor.

16. A beverage dispenser as defined in claim 1, wherein said container coupling means including liquid sensor means for detecting said liquid in said container adaptor.

17. A beverage dispenser as defined in claim 14, wherein said container coupling means including liquid sensor means for detecting said liquid in said container adaptor.

18. A beverage dispenser as defined in claim 15, wherein said container coupling means including liquid sensor means for detecting said liquid in said container adaptor.

19. A beverage dispenser as defined in claim 1, wherein said flow means is at least one modular component, each of said modular component including one pump means and one container coupling means to control the flow rate of said liquid in one of said container means.

20. A beverage dispenser as defined in claim 2, wherein said flow means is at least one modular component, each of said modular component including one pump means and one container coupling means to control the flow rate of said liquid in one of said container means.

21. A beverage dispenser as defined in claim 17, wherein said flow means is at least one modular component, each of said modular component including one pump means and one container coupling means to control the flow rate of said liquid in one of said container means.

22. A beverage dispenser as defined in claim 18, wherein said flow means is at least one modular component, each of said modular component including one pump means and one container coupling means to control the flow rate of said liquid in one of said container means.

23. A modular fluid metering controller for controlling the flow of a liquid from a liquid source to a liquid discharger, said controller including container coupling means for connecting said liquid container, said connector coupling means including a flush valve, a connector adaptor, a connector bottom, and sealing means for substantially sealing said flush valve between said container adaptor and said connector bottom, said sealing means including at least one seating section, at least one seal, at least one seat cavity and connecting means for at least partially securing said seal to said seating section.

24. A fluid metering controller as defined in claim 23, wherein said connector bottom including a bottom base connected to one of said seating section.

25. A fluid metering controller as defined in claim 23, wherein said flush valve including one of said seat cavity for telescopically receiving one of said seating section.

26. A fluid metering controller as defined in claim 24, wherein said flush valve including one of said seat cavity for telescopically receiving one of said seating section.

27. A fluid metering controller as defined in claim 25, wherein said seat cavity of said flush valve positioned at the base of said flush valve.

28. A fluid metering controller as defined in claim 26, wherein said seat cavity of said flush valve positioned at the base of said flush valve.

29. A fluid metering controller as defined in claim 23, wherein said flush valve including a seating section.

30. A fluid metering controller as defined in claim 24, wherein said flush valve including a seating section.

31. A fluid metering controller as defined in claim 27, wherein said flush valve including a seating section.

32. A fluid metering controller as defined in claim 28, wherein said flush valve including a seating section.

33. A fluid metering controller as defined in claim 29, wherein said seating section is connected to the base of said flush valve.

34. A fluid metering controller as defined in claim 29, wherein said seating section is connected to the top of said flush valve.

35. A fluid metering controller as defined in claim 31, wherein said seating section is connected to the top of said flush valve.

36. A fluid metering controller as defined in claim 32, wherein said seating section is connected to the top of said flush valve.

37. A fluid metering controller as defined in claim 23, wherein said container adaptor having a top and bottom body portion, said bottom body portion including a seating section.

38. A fluid metering controller as defined in claim 27, wherein said container adaptor having a top and bottom body portion, said bottom body portion including a seating section.

39. A fluid metering controller as defined in claim 33, wherein said container adaptor having a top and bottom body portion, said bottom body portion including a seating section.

40. A fluid metering controller as defined in claim 23, wherein said container adaptor having a top and bottom body portion, said bottom body portion including said seat cavity.

41. A fluid metering controller as defined in claim 30, wherein said container adaptor having a top and bottom body portion, said bottom body portion including said seat cavity.

42. A fluid metering controller as defined in claim 25, wherein said container adaptor having a top and bottom body portion, said bottom body portion including said seat cavity.

43. A fluid metering controller as defined in claim 35, wherein said container adaptor having a top and bottom body portion, said bottom body portion including said seat cavity.

44. A fluid metering controller as defined in claim 36, wherein said container adaptor having a top and bottom body portion, said bottom body portion including said seat cavity.

45. A fluid metering controller as defined in claim 34, wherein said container adaptor having a top and bottom body portion, said bottom body portion including said seat cavity.

46. A fluid metering controller as defined in claim 23, wherein said connecting means of said seating section includes a slot positioned about the peripheral edge of said seating section for at least partially receiving said seal.

47. A fluid metering controller as defined in claim 39, wherein said connecting means of said seating section includes a slot positioned about the peripheral edge of said seating section for at least partially receiving said seal.

48. A fluid metering controller as defined in claim 45, wherein said connecting means of said seating section includes a slot positioned about the peripheral edge of said seating section for at least partially receiving said seal.

49. A fluid metering controller as defined in claim 41, wherein said connecting means of said seating section includes a slot positioned about the peripheral edge of said seating section for at least partially receiving said seal.

50. A fluid metering controller as defined in claim 43, wherein said connecting means of said seating section includes a slot positioned about the peripheral edge of said seating section for at least partially receiving said seal.

51. A fluid metering controller as defined in claim 44, wherein said connecting means of said seating section includes a slot positioned about the peripheral edge of said seating section for at least partially receiving said seal.

52. A fluid metering controller as defined in claim 23, wherein said seating section substantially circular cross-sectional area.

53. A fluid metering controller as defined in claim 47, wherein said seating section substantially circular cross-sectional area.

54. A fluid metering controller as defined in claim 48, wherein said seating section substantially circular cross-sectional area.

55. A fluid metering controller as defined in claim 49, wherein said seat cavity having a substantially circular cross-sectional area.

56. A fluid metering controller as defined in claim 50, wherein said seat cavity having a substantially circular cross-sectional area.

57. A fluid metering controller as defined in claim 51, wherein said seat cavity having a substantially circular cross-sectional area.

58. A fluid metering controller as defined in claim 23, wherein said flush valve movable between a first and a second position, said first position providing a passageway between said container adaptor and said connector bottom and said second position closing said passageway between said container adaptor and said connector bottom.

59. A fluid metering controller as defined in claim 56, wherein said flush valve movable between a first and a second position, said first position providing a passageway between said container adaptor and said connecter bottom and said second position closing said passageway between said container adaptor and said connector bottom.

60. A fluid metering controller as defined in claim 57, wherein said flush valve movable between a first and a second position, said first position providing a passageway between said container adaptor and said connecter bottom and said second position closing said passageway between said container adaptor and said connector bottom.

61. A fluid metering controller as defined in claim 58, wherein said second position of said flush valve providing a passageway for a flushing liquid to flow in said connector coupling means.

62. A fluid metering controller as defined in claim 59, wherein said second position of said flush valve providing a passageway for a flushing liquid to flow in said connector coupling means.

63. A fluid metering controller as defined in claim 60, wherein said second position of said flush valve providing a passageway for a flushing liquid to flow in said connector coupling means.

64. A fluid metering controller as defined in claim 58, including detection means for detecting at least one position of said flush valve.

65. A fluid metering controller as defined in claim 62, including detection means for detecting at least one position of said flush valve.

66. A fluid metering controller as defined in claim 63, including detection means for detecting at least one position of said flush valve.

67. A fluid metering controller as defined in claim 23, including liquid sensor means for detecting a liquid in said connector coupling means.

68. A fluid metering controller as defined in claim 53, including liquid sensor means for detecting a liquid in said connector coupling means.

69. A fluid metering controller as defined in claim 54, including liquid sensor means for detecting a liquid in said connector coupling means.

70. A fluid metering controller as defined in claim 55, including liquid sensor means for detecting a liquid in said connector coupling means.

71. A fluid metering controller as defined in claim 65, including liquid sensor means for detecting a liquid in said connector coupling means.

72. A fluid metering controller as defined in claim 66, including liquid sensor means for detecting a liquid in said connector coupling means.

73. A fluid metering controller as defined in claim 23, wherein said container coupling means including actuator means for opening a valve in said liquid source.

74. A fluid metering controller as defined in claim 71, wherein said container coupling means including actuator means for opening a valve in said liquid source.

75. A fluid metering controller as defined in claim 72, wherein said container coupling means including actuator means for opening a valve in said liquid source.

76. A fluid metering controller as defined in claim 23, wherein said container coupling means including molded components.

77. A fluid metering controller as defined in claim 74, wherein said container coupling means including molded components.

78. A fluid metering controller as defined in claim 75, wherein said container coupling means including molded components.

79. A fluid metering controller as defined in claim 23, including pump means for controllably moving said liquid from said liquid source and through said container coupling means.

80. A fluid metering controller as defined in claim 77, including pump means for controllably moving said liquid from said liquid source and through said container coupling means.

81. A fluid metering controller as defined in claim 78, including pump means for controllably moving said liquid from said liquid source and through said container coupling means.

* * * * *